United States Patent [19]
Yamasaki
[11] Patent Number: 4,821,248
[45] Date of Patent: Apr. 11, 1989

[54] WORLD TIMEPIECE

[75] Inventor: Masaharu Yamasaki, Tokyo, Japan
[73] Assignee: Seiko Instruments Inc., Tokyo, Japan

[21] Appl. No.: 65,260
[22] Filed: Jun. 22, 1987
[30] Foreign Application Priority Data
Jun. 20, 1986 [JP] Japan ..... 61-144525
[51] Int. Cl.[4] ..... G04B 19/22
[52] U.S. Cl. ..... 368/21
[58] Field of Search ..... 368/21-24

[56] References Cited
U.S. PATENT DOCUMENTS
4,274,151 6/1981 Kamiwaki ..... 368/21
4,316,272 2/1982 Naito ..... 368/21
FOREIGN PATENT DOCUMENTS
60-56280 4/1985 Japan ..... 368/21

*Primary Examiner*—Vit W. Miska
*Attorney, Agent, or Firm*—Bruce L. Adams; Van C. Wilks

[57] ABSTRACT
A world timepiece having means for controlling the time correction of the fundamental time that the fundamental time is interlocked to the time of a region having time difference when the correction amount is shorter than a time-differential unit time (thirty minutes or one hour), and is not interlocked when the correction amount is equal to the multiple of the time-differential unit time.

8 Claims, 3 Drawing Sheets

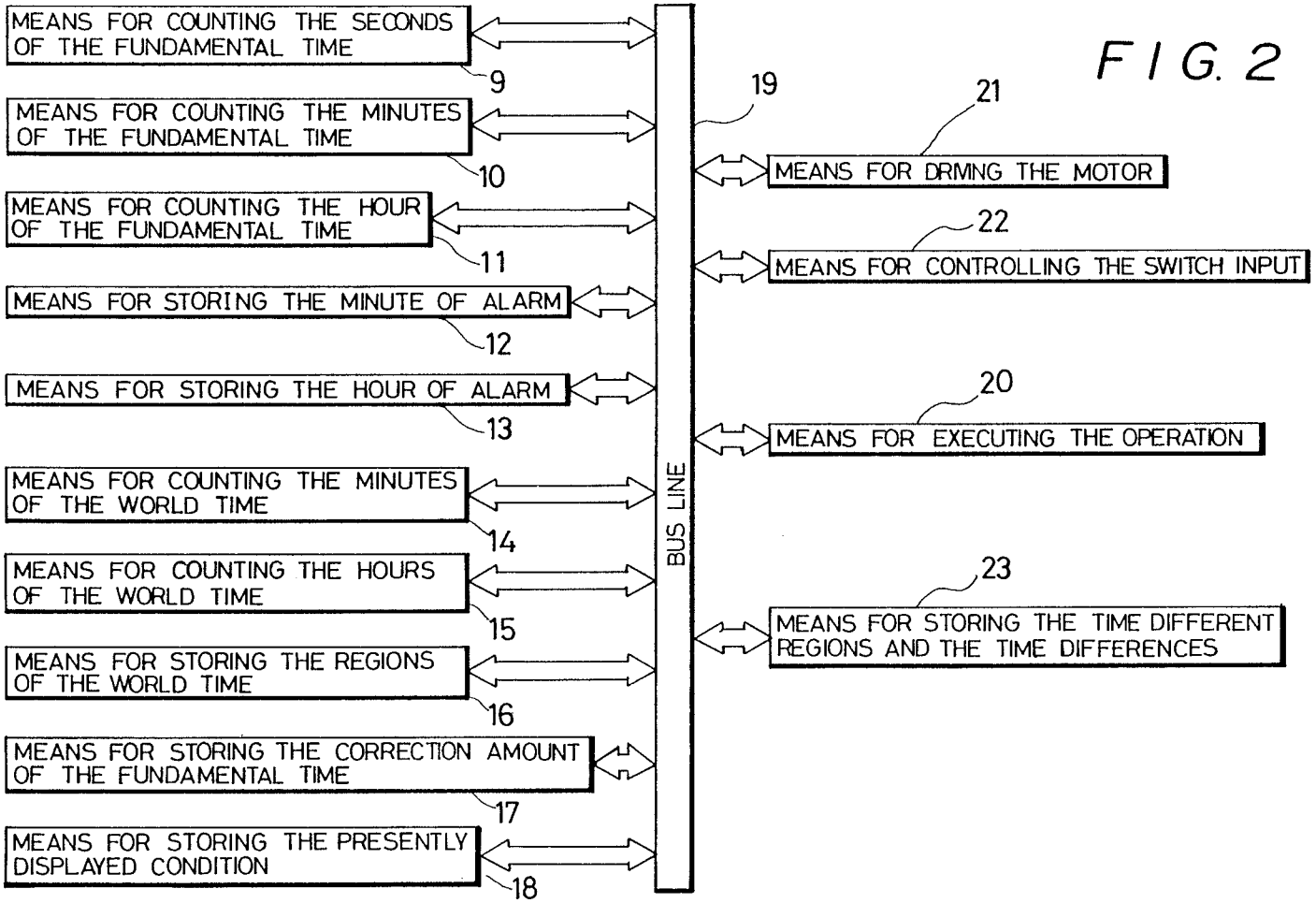
FIG. 2
MEANS FOR DRIVING THE MOTOR
21
MEANS FOR CONTROLLING THE SWITCH INPUT
22
MEANS FOR EXECUTING THE OPERATION
20
MEANS FOR STORING THE TIME DIFFERENT REGIONS AND THE TIME DIFFERENCES
23
19
BUS LINE
MEANS FOR COUNTING THE SECONDS OF THE FUNDAMENTAL TIME
9
MEANS FOR COUNTING THE MINUTES OF THE FUNDAMENTAL TIME
10
MEANS FOR COUNTING THE HOUR OF THE FUNDAMENTAL TIME
11
MEANS FOR STORING THE MINUTE OF ALARM
12
MEANS FOR STORING THE HOUR OF ALARM
13
MEANS FOR COUNTING THE MINUTES OF THE WORLD TIME
14
MEANS FOR COUNTING THE HOURS OF THE WORLD TIME
15
MEANS FOR STORING THE REGIONS OF THE WORLD TIME
16
MEANS FOR STORING THE CORRECTION AMOUNT OF THE FUNDAMENTAL TIME
17
MEANS FOR STORING THE PRESENTLY DISPLAYED CONDITION
18

WORLD TIMEPIECE

BACKGROUND OF THE INVENTION

1. Field of the Invention

The present invention relates to a world timepiece which is capable of displaying the time of a particular region having time difference.

2. Description of the Prior Art

World timepieces have heretofore been constituted at least by a world time mode portion that displays the time of a selected region having time difference and a home time mode portion that displays a fundamental time. The fundamental time stands for a time of one of the regions which is designated as a home time. Therefore, the fundamental time is limited to a time that can be displayed in the world time mode.

In a world timepiece which displays the time of a particular region having a time difference, the fundamental time stands for a time of that region where a home time is designated. Therefore, it is not allowed to set the fundamental time to a time other than the time of the predetermined particular region having time difference. Namely, it is not allowed to use the world timepiece in the regions other than the particular region having time difference.

SUMMARY OF THE INVENTION

It is an object of the present invention to provide a world timepiece which is allowed to set the fundamental time to a time other than the time of the particular region having time difference.

According to the present invention, provision is made of means for controlling the time correction of the fundamental time so that the fundamental time is interlocked to the time of a region having time difference when the correction amount is shorter than a time-differential unit time (for example, one hour or 30 minutes), and is not interlocked when the correction amount is equal to the multiple of the time-differential unit time.

According to a world timepiece which displays the time of a particular region having time difference based upon the above-mentioned method, the fundamental time can be set to the time of a region other than a particular region having time difference without being limited to the time of the particular region stored in the memory means. Therefore, the timepiece can be used in a region having a time difference other than the particular region having time difference which is preset in the world timepiece.

BRIEF DESCRIPTION OF THE DRAWINGS

FIG. 2 is a block diagram illustrating in detail the processor and the periphery thereof shown in FIG. 1.

DETAILED DESCRIPTION OF THE PREFERRED EMBODIMENT

Figure 1:
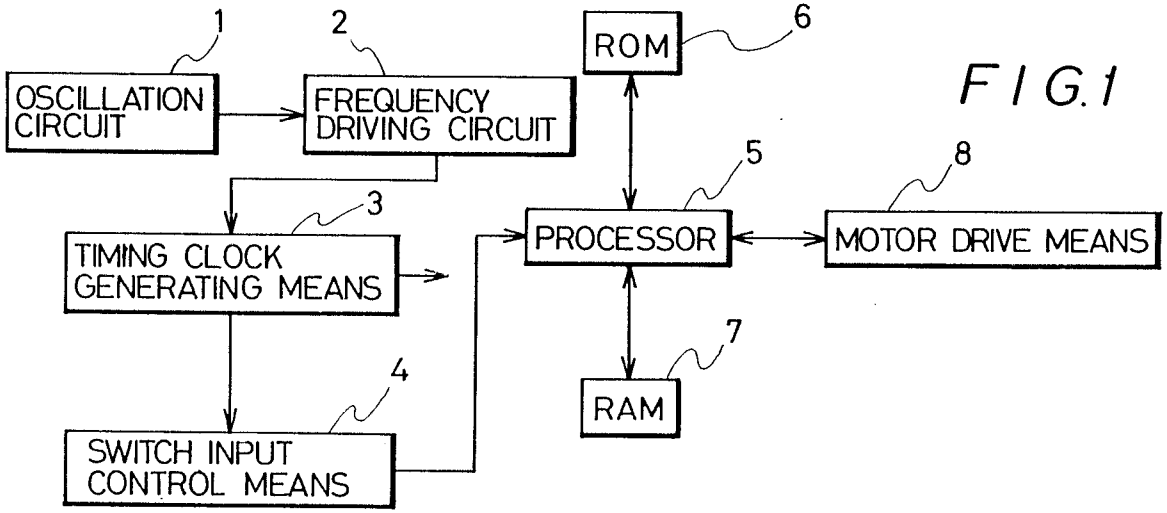
FIG. 1 is a block diagram illustrating an embodiment of the present invention.

An embodiment of the invention will now be described in conjunction with the drawings. FIG. 1 is a block diagram which illustrates an embodiment of the present invention, wherein reference numeral 1 denotes an oscillation circuit including a quartz oscillator as a source of oscillation, reference numeral 2 denotes a frequency-dividing circuit which divides the frequency of outputs of the oscillation circuit 1, reference numeral 3 denotes clock generating means which generates timing clock signals necessary for operating the whole system in response to the outputs of the frequency-dividing circuit 2, reference numeral 4 denotes switch input control means which controls the switch input depending upon the timing determined by the clock generating means 3, reference numeral 5 denotes a processor which calculates and controls outputs for a ROM 6, for a RAM 7, and for motor drive means 8 according to the outputs of the clock generating means 3 and switch input control means 4, reference numeral 6 denotes the ROM that stores the instruction in which operation procedure of the timepiece is programmed, 7 denotes the RAM that temporarily stores the time data or the like, and reference numeral 8 denotes the motor drive means that drives the hands.

Figure 3:
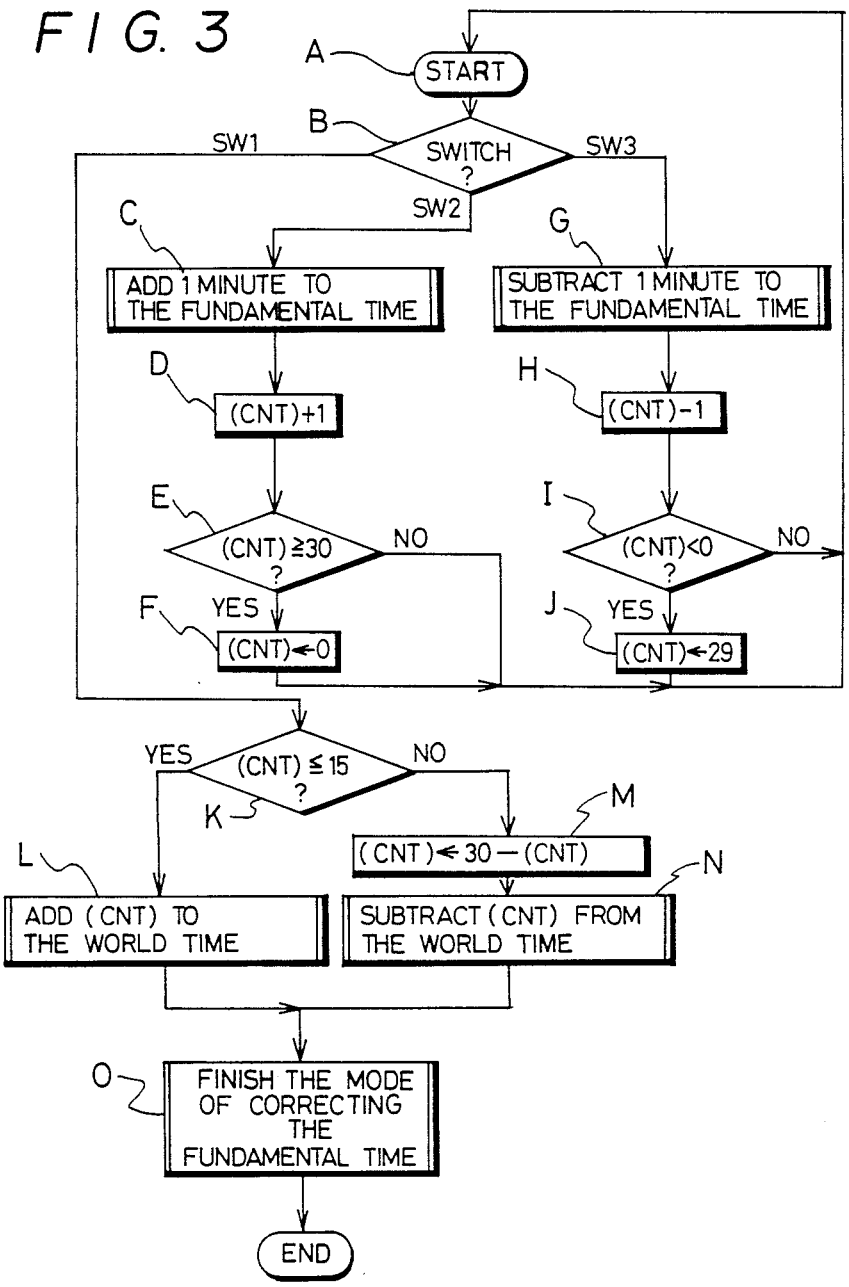
FIG. 3 is a flow chart illustrating the procedure of data processing executed according to the present invention.

FIG. 2 is a block diagram of a circuit which illustrates in detail the processor 5 and the periphery thereof, and FIG. 3 is a flow chart of the processing executed by the processor 5.

The RAM 7 circuit is constituted by counting means 9 for counting the seconds of a fundamental time, counting means 10 for counting the minutes of the fundamental time, counting means 11 for counting the hours of the fundamental time, memory means 12 for storing the minute of alarm, memory means 13 for storing the hour of alarm, counting means 14 for counting the minutes of the world time, counting means 15 for counting the hours of the world time, memory means 16 for storing regions of the world time, memory means 17 for storing the correction amount of the fundamental time, and memory means 18 for storing the presently displayed time information. The RAM, motor driving means 21, controlling means 22 that controls the switch input, and memory means 23 that stores regions having time difference and the time differences, are connected to CPU means 20 (hereinafter referred to as CPU) that executes the operation via a bus line 19.

Operation of the thus constructed embodiment will now be described. In response to 1-Hz signals produced by the clock generating means 3 shown in FIG. 1, the data of counting means 9 that counts the seconds of the fundamental time is read, via the bus line 19, by the CPU 20 where data "1" is added thereto. The data that is shorter than 60 seconds is stored, via the bus line 19, in the counting means 9 that counts the seconds of the fundamental time. The data that is longer than 60 seconds, on the other hand, is rewritten as data 0 and is stored, via the bus line 19, in the counting means 9 that counts the seconds of the fundamental time. When a carry has developed in the data, the upper digit is read by the CPU 20 and is processed in the same manner as the above-mentioned procedure that counts the seconds of the fundamental time. When the digits greater than the digit of minute of the fundamental time are counted, the same processing is executed even for the minute of the world time and the hour of the world time. Then the CPU 20 compares the data of the memory means 18 that stores the presently displayed time information with the data after it is processed. When it is necessary to move the hands, the CPU 20 sends data, via the bus line 19, to the motor driving means 21 that drives the motor, whereby the hands are moved by the output of the motor driving means 21 that drives the motor. Procedures of these operations are all stored in the ROM 6 shown in FIG. 1.

In the system which is ordinarily operated as described above, when a mode for correcting the fundamental time is assumed due to the operation of the switch, the processing of the flow chart of FIG. 3 is carried out.

In FIG. 3, symbol SW1 denotes a lock/unlock switch, SW2 denotes a switch for correcting the time indication in the forward direction, and SW3 denotes a switch for correcting the time indication in the reverse direction. These switches are connected to the controlling means 22 (not shown) that controls the switch input. Symbol (CNT) denotes the content of the memory means 17 that stores the correction amount of the fundamental time and that is reset when the mode for correcting the fundamental time is assumed. When the switch is manipulated, the output of the controlling means 22 that controls the switch input is sent, via the bus line, to the CPU 20, whereby the processing is carried out starting from the step A as shown in FIG. 3 under the control of the CPU 20. When the SW2 is operated once, one minute is added to the fundamental time and data "1" is added to the data of (CNT). When the SW3 is operated once, one minute is subtracted from the fundamental time and 1 is subtracted from the data of (CNT). The procedure of arithmetic processing will now be described in conjunction with the flow chart.

When the SW2 is operated, a step B discriminates the input from the SW2 and the program proceeds to a step C where the data of the counting means 10 that counts the minutes of the fundamental time is read, via the bus line 19, by the CPU 20 that adds the data "1" thereto. The data that becomes longer than "60" is rewritten as "0" and is stored, via the bus line 19, in the counting means 10 which counts the minutes of the fundamental time. The data that is shorter than "60" is stored, via the bus line 19, in the counting means 10 which counts the minutes of the fundamental time. When a carry has developed in the date, the same processing is effected for the upper digit. The program then proceeds to a step D where the data of (CNT) is read, via the bus line 19, by the CPU 20 that adds the data "1" thereto. Then, a step E discriminates whether the data is greater than "30" or not. The data that is greater than or equal to "30" is rewritten as "0" in a step F and is stored again in the memory means 17. The data that is smaller than "30" is stored in the memory means 17 via bus line 19, and the program returns to the starting step A. When the SW3 is operated, the program proceeds from the step B to a step G where one minute is subtracted from the data of hour and minute of the fundamental time like the case when the SW2 is operated, and data "1" is subtracted from the (CNT) data in a step H.

Then, a step I discriminates whether the (CNT) data has a negative value or not. When the (CNT) data has a negative value, a step J changes the data to "29". When the (CNT) data is greater than "0", the data is stored in the memory means 17 and the program returns to the starting step A. The above-mentioned processings are repeated every time when the SW2 and SW3 are operated.

In the above-mentioned processing, the data of (CNT) remains within a range of "0" to "29" no matter how much amount the fundamental time is corrected because the data of (CNT) is divided by an equal time difference data "30" to calculate the remainder. The fundamental time is corrected to a desired time by operating the SW2 and SW3, and then the Sw1 is operated to execute another processing starting with the step B. A step K discriminates the data of (CNT). When the data is smaller than or equal to "15", a step L adds the data of (CNT) to the hour and minute data of the world time. When the data of (CNT) is greater than "15", on the other hand, a step M stores in the (CNT) a value that is obtained by subtracting the data of (CNT) from "30", and a step N subtracts the data of (CNT) from the hour and minute data of the world time. Finally, a step 0 executes the processing to shift the mode of correcting the fundamental time to the ordinary mode of the fundamental time.

When the fundamental time is corrected in the fundamental time correcting mode in accordance with the present invention as described above, the world time is not interlocked or related to a portion of the correction amount larger than the time-differential unit time or the equal time difference (which in this embodiment is set to be thirty minutes, but may be one hour). Therefore, the fundamental time can be set to any time other than the world times the regions or time zones arranged progressively at the equal time difference stored in the memory means 23. The world time, however, is interlocked to the correction amount (which in this embodiment lies over a range of −14 minutes to +15 minutes) which is shorter than the time-differential unit time. Therefore, the world time can also be corrected simultaneously at the time when the fundamental time that goes slow or fast is corrected. In the world timepiece which stores and displays the time of a particular region having time difference, therefore, the standard time of a region other than the particular region can be set as the reference time. Therefore, the timepiece can be used in any region.

What is claimed is:

1. A world timepiece comprising:

an oscillation circuit including a quartz oscillator as a source of oscillation for producing an output signal having a given frequency;

a frequency-dividing circuit for dividing the frequency of the output signal of the oscillation circuit to produce divided signals;

means for generating timing clock signals in response to the divided output signals of the frequency-dividing circuit;

means for counting a fundamental time in response to the timing clock signals;

means for storing a plurality of regions having time differences in terms of a time-differential unit time and for storing the time differences;

means for counting a world time of a given region among the plurality of regions having time differences in response to the timing clock signals;

external operation means for inputting a correction amount of the fundamental time;

means for storing data representative of the correction amount of the fundamental time inputted by the external operation means;

counting means for counting the correction amount of the fundamental time to obtain a count value calculated by subtracting a multiple of the time-differential unit time from the correction amount of the fundamental time, said counting means including comparing means for generating a resetting signal for resetting the counting means each time the count value becomes the same as that of the time-differential unit time; and means for correcting the world time in accordance with the count value.

2. A world timepiece as claimed in claim 1; including a plurality of hands for indicating the fundamental time or the world time of a given region; means for storing data representative of the fundamental time and the world time to be indicated by the hands; a stepping motor for intermittently rotating the hands; and means for driving the stepping motor.

3. A world timepiece as claimed in claim 1; wherein the time-differential unit time is set to be thirty minutes.

4. A world timepiece as claimed in claim 1; wherein the time-differential unit time is set to be one hour.

5. A timepiece for indicating world times assigned to corresponding time zones and progressively arranged relative to each other at an equal time difference according to the time zones and for indicating a home time settable between adjacent world times, the timepiece comprising: means for producing a clock signal; first counting means for counting a home time in response to the clock signal; first memory means for storing the counted home time; first correcting means for correcting the stored home time by a given correction amount of time; second counting means for counting a world time assigned to a given time zone in response to the clock signal; second memory means for storing the counted world time; means for arithmetically processing the correction amount of time to divide the same by the equal time difference to thereby calculate a remainder; second correcting means for correcting the stored world time according to the calculated remainder to thereby maintain the assignment of the corrected world time to the corresponding time zone after the correction of the home time; and indicating means for indicating the stored home and world times.

6. A timepiece as claimed in claim 5; wherein the indicating means includes a plurality of time-indicating hands; and a stepping motor for stepwisely rotating the time-indicating hands to indicate the home and world times.

7. A timepiece as claimed in claim 5; including means for progressively arranging world times at an equal time difference of thirty minutes.

8. A timepiece as claimed in claim 5; including means for progressively arranging world times at an equal time difference of one hour.

* * * * *